US005604471A

United States Patent [19]

Ráttilá et al.

[11] Patent Number: 5,604,471

[45] Date of Patent: Feb. 18, 1997

[54] RESONATOR DEVICE INCLUDING U-SHAPED COUPLING SUPPORT ELEMENT

[75] Inventors: Tapio Ráttilá; Pertti Puurunen; Seppo Salmela, all of Kempele; Jarmo Valtonen, Jaali; Kari Lohtander, Tymävä, all of Finland

[73] Assignee: LK Products OY, Kempele, Finland

[21] Appl. No.: 403,380

[22] Filed: Mar. 15, 1995

[30] Foreign Application Priority Data

Mar. 15, 1994 [FI] Finland ..... 941219

[51] Int. Cl.[6] ..... H01P 1/20

[52] U.S. Cl. ..... 333/202; 333/206; 333/219; 333/207

[58] Field of Search ..... 333/202, 206, 333/207, 219, 222

[56] References Cited

U.S. PATENT DOCUMENTS

| | | | |
|---|---|---|---|
| 2,762,017 | 4/1956 | Bradburd et al. . | |
| 3,936,776 | 2/1976 | Sunquist | 333/202 |
| 4,342,969 | 3/1982 | Meyers et al. . | |
| 4,816,788 | 3/1989 | Ishikawa et al. | 333/202 |
| 5,047,739 | 9/1991 | Kuokkanen | 333/219 |
| 5,351,023 | 9/1994 | Niiranen | 333/202 |

FOREIGN PATENT DOCUMENTS

| | | |
|---|---|---|
| 1446377 | 6/1969 | Germany . |
| 2144713 | 7/1972 | Germany . |

OTHER PUBLICATIONS

B. Rawat et al. *IEEE Transactions on Vehicular Technology* 33:1 32–36 1984, 'Improved Design of a Helical Resonator Filter for 450–500 MHz Ban Land Mobile Communication' 32:In 1–13 FIG. 1.

*Primary Examiner*—Benny Lee
*Assistant Examiner*—Darius Gambino
*Attorney, Agent, or Firm*—Darby & Darby

[57] ABSTRACT

The present invention relates to a coupling element (21) by which the coupling of a resonator (24) is adjusted in a radio frequency filter. The coupling element of the invention is a strip made of flexible conductor material being shaped symmetrical relative to the normal, that is, the symmetry axis of the longitudinal axis extending via the centrepoint of the strip in the longitudinal direction. The strip (21) is fixed at least at two points of an edge in the longitudinal direction to the circuit board (25) either by surface mounting on pads (33, 35, 36) or by soldering into holes borred in the circuit board to be at appropriate space from the resonator coil (34) and from the surface of the circuit board (25). One (33) of the fixing points is grounded and another (36) is connected to the signal conductor in the filter. The coupling can easily be adjusted by bending the board relative to the symmetry axis either one-sidedly or on both sides.

13 Claims, 5 Drawing Sheets

RESONATOR DEVICE INCLUDING U-SHAPED COUPLING SUPPORT ELEMENT

BACKGROUND OF THE INVENTION

The present invention relates to a resonator device including a transmission line resonator and a coupling element for controlling the frequency response of the resonator device. The present invention has application in radio frequency filters.

In radio transceivers duplex filters based on transmission line resonators are generally used to prevent access of a signal to be transmitted to the receiver and that of the received signal to the transmitter. Each multi-channel radio phone network has a transmission and reception frequency band specified for it. The difference of the reception frequency and the transmission frequency during connection, the duplex interval, is also consistent with the network specification. Hence, for each network such a duplex filter should be designed which is just appropriate for it. It is not, however, economical to design a variety of different duplex filters for different radio phone networks, but the stop bands and pass bands of the filter are made, as far as possible, adjustable to some extent, whereby such filters are also suitable for use with greater or smaller bandwidths than those serving as basis for the original design. Mostly, there is no great need to adjust the stop bands or passbands, and any desired new bandwidth is thus achieved simply by increasing or decreasing the coupling between the resonator circuits in the filter. The number of resonators may then be left unchanged.

A helical coil resonator is a transmission line resonator which is widely used in high frequency range filters. A quarter-wave resonator comprises inductive elements, which are a wire wound to form a cylindrical coil, one end thereof being short-circuited, and a conductive shell encircling the coil. The conductive shell is connected to the low impedance, short-circuited end of the coil. The capacitive element of the resonator is formed between the open end of the coil and the conductive shell around the coil. A coupling to the resonator can be made either capacitively at the upper end of the resonator coil in which the electric field is strong, or inductively at the lower end of the coil in which the magnetic field is strong, or a coupling aperture may be used. The last mentioned system is used between two resonators. An inductive coupling is provided when a wire to be connected is terminated with a coupling link placed in a strong magnetic field in a resonator. The coupling is more effective the larger the coupling link and the stronger the magnetic field of the resonator acting in the coupling link.

A coupling to a resonator may also be made by connecting a wire to be coupled directly to a resonator coil, most often to the first turn thereof. This method is called tapping. The tapping point determines the input impedance detected by the wire to be coupled in the direction of the resonator, and it can be defined either by testing or by calculation. A drawback in a coupling made by tapping is that, because of the fixed direct contest the input impedance and thus, the strength of the coupling, cannot be controlled at all.

An adjustable inductive coupling can, as is well known in the art, be implemented using a so-called wire link, referentially depicted in FIGS. 1A and 1B. FIG. 1A shows a resonator in top view, and FIG. 1B is a side view. Reference numeral 1 in the figures refers to a helical coil provided with a straight leg part 2 inserted in a hole made in a circuit board 3 and soldered to the metallized cover of the board surface, and becoming grounded thereby. The metallization is shown with one solid line. Only a few lowermost turns of the coil are shown. The wire link 4, shown in top view in FIG. 1A, is a bent piece of wire, the ends 5, 6 thereof being bent towards the circuit board 3, and at both ends it is inserted into the holes borred in the circuit board 3, FIG. 1B. In wave soldering, one end 5 is soldered to the metallized surface of the opposite side of the circuit board viewed from the resonator 1 and is grounded thereby. The other end is soldered to the wire strip 8 on the surface of the circuit board 3 facing the resonator, by which the radio frequency signal is conducted to the wire link 4. The self-inductance of the wire link 4 forms an inductive element by which a resonance is made via the electromagnetic field to the resonator 1. The self-inductance is determined by the thickness and length of the wire. The wire link 4 is located in the immediate vicinity of a first turn of the resonator coil 1 located on the same circuit board 3, FIG. 1A, and in The direction therewith, FIG. 1B. The nodes 7 and 9 on the ends of the wire link 4 keep it in the right position during the wave soldering, thus preventing the wire from sliding too far through the circuit board 3. The mutual inductance between the wire link 4 and the resonator 1, and hence The coupling, is adjusted by pressing the link towards the circuit board, or off therefrom, in the direction of arrow A, FIG. 1B.

This prior art approach is encumbered with certain drawbacks. Depending on the position and size of the resonator coil, a number of wire link designs of different thicknesses and shapes are needed in order to implement a desired coupling and adjustment. Adjusting the position of a wire link attached to a circuit board in the tuning phase of a filter is difficult because, firstly, the wire may be thick and therefore rigid, and secondly, when bending a wire, the foil of the circuit board may easily break. If no holes are used and the wire link is soldered to the wire pads on the surface of the circuit board 3, the wire pad foil can be torn off from the surface. In most instances, it is not desirable to have any projecting parts on the outer surface of The filter, or as in the present instance, on the outer surface of the circuit board.

SUMMARY OF THE INVENTION

An object of the present invention is to develop an easily adjustable inductive coupling element.

Accordingly, in one aspect the present invention provides a resonator device suitable for use in a radio frequency filter comprising a helical resonator coil and an elongate inductive coupling element mounted on a circuit board in electromagnetically-coupled relation to each other, the coupling element having a short-circuited end and an end for providing a signal path to the resonator devise wherein the coupling element comprises a fork-like conductive strip comprising two branches between which the helical resonator coil is located.

The coupling element set forth here is an elongate strip. The requirement that the coupling element of the present invention is a strip dictates that its width is considerably greater than its thickness, whereby easy and reliable bending of the coupling element is possible.

The strip has been bent at at least one point along the length of the strip so as to for the fork-like pattern which is visible, when viewing the strip such that its thickness is visible. The strip may be at least at the ends attached to the circuit board with suitable fixing means to be at a given distance from the surface thereof and in the direction of the surface thereof so that the resonator is disposed into the fork of the bent strip symmetrically thereto. Preferably, the fixing means at one end of the strip conducts a signal to be coupled to the strip, whereas the fixing means at the apposite end short-circuits that end of the strip. It will be understood that "short-circuited" in the context of the present invention is to be construed broadly so as to include tying the end of the strip to a fixed potential, irrespective of whether the fixed potential is ground (OV) or not.

In an advantageous embodiment, the fixing means are projections at the ends of the strip in the plane of the strip and at right-angles to the longitudinal axis of the strip. The projections have been formed in the same process during which the strips are cut from a copper web. The tips of the projections which are placed against the surface of The circuit board may also be bent in order to have a larger soldering surface area if surface mounting is employed.

In another embodiment, the fixing means comprise supports mounted on the surface of The circuit board and projecting therefrom, to the tips whereof the strip is attached.

In an advantageous embodiment, the strip is fixed also at the symmetry axis to the circuit board with fixing means of the above type, whereby the rigidness and aligning of the adjustment only to a given point of the strip are improved.

For instance, a strip bent in V-shape is easy to arrange on resonator coils differing in diameter by positioning the strip in the assembly step at an appropriate space from the resonator coil. After fixing the strip, the electromagnetic coupling between the coil and the strip can easily be adjusted by bending the strip relative to the symmetry axis, either on one side or both sides, either facing the resonator coil in order to strengthen the coupling, or away from the resonator coil to weaken the coupling.

Other aspects and subsidiary features of the invention are given in the appended claims.

BRIEF DESCRIPTION OF THE DRAWINGS

Exemplary embodiment of the invention are described below more in detail referring to the accompanying drawings, in which.

DESCRIPTION OF THE PREFERRED EMBODIMENT

Figure 1A:
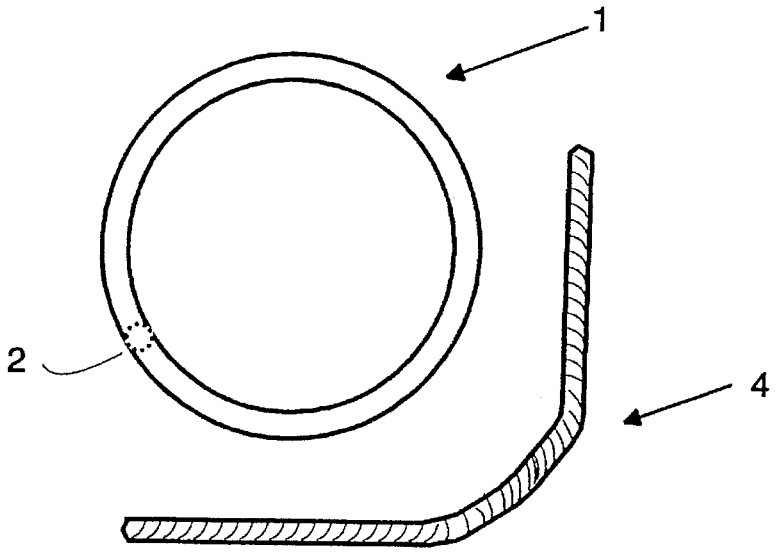
FIGS. 1A and 1B illustrate a prior art resonator device.
Figure 1B:
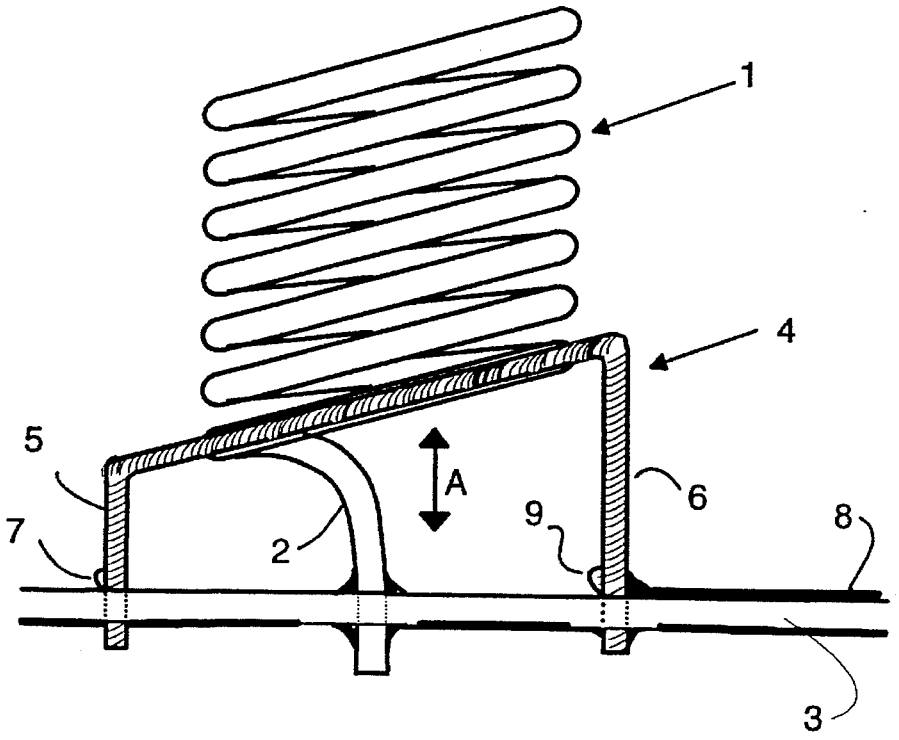
Figure 2:
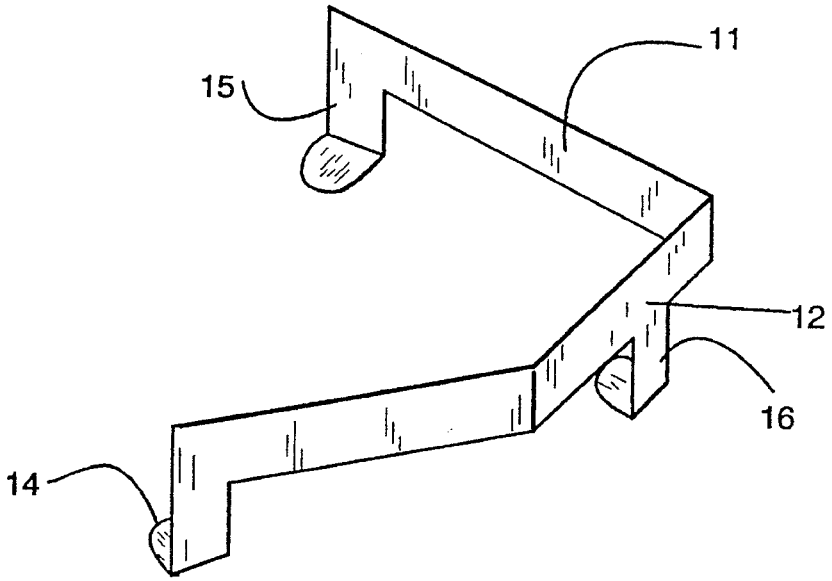
FIG. 2 presents a coupling element according to the invention.

Referring to FIG. 2, a coupling element 11 is made from a flexible conductive board, such as thin copper web, the thickness thereof being preferably 0.1 to 0.3 mm. An elongate strip 10, having a longitudinal axis and a centre point 12 midway therealong, is cut off or punched from the board. Then the strip 10 is bent along two axes, which are transverse to the longitudinal axis and equally spaced from its centre point, in a direction towards the normal of the strip, whereby a fork-like member is produced as shown in FIG. 2. This shape of the coupling element is easy to adapt for coils of different diameters by changing the distance between the coupling element and the resonator coil while mounting the element adjacent to the resonator coil on the circuit board, as will be described below.

When forming a coupling element, it is advantageous to cut coupling legs 14, 15, 16 at the same time from the same conductive board. The legs are made simply from short tabs extending at right angles to the longitudinal axis of the strip. As shown in FIG. 2, the tips of the coupling legs can be bent into feet to facilitate surface mounting. In an alternative embodiment (not shown) the legs can be formed from spike-like elements for through-hole mounting. The signal can be conducted to the element e.g. via leg 14 with the other end of the strip being grounded by leg 15. The supporting leg 16 at the centre point of the longitudinal axes of the strip is mounted on a conductive pad on the surface of the circuit board in the soldering phase.

The supporting leg 16 may also be of an insulating material, for instance a pin made from plastic, which is first attached to the circuit board e.g. by nozzling. Its tip is provided with a runner by which the coupling element is supported.

Figure 3:
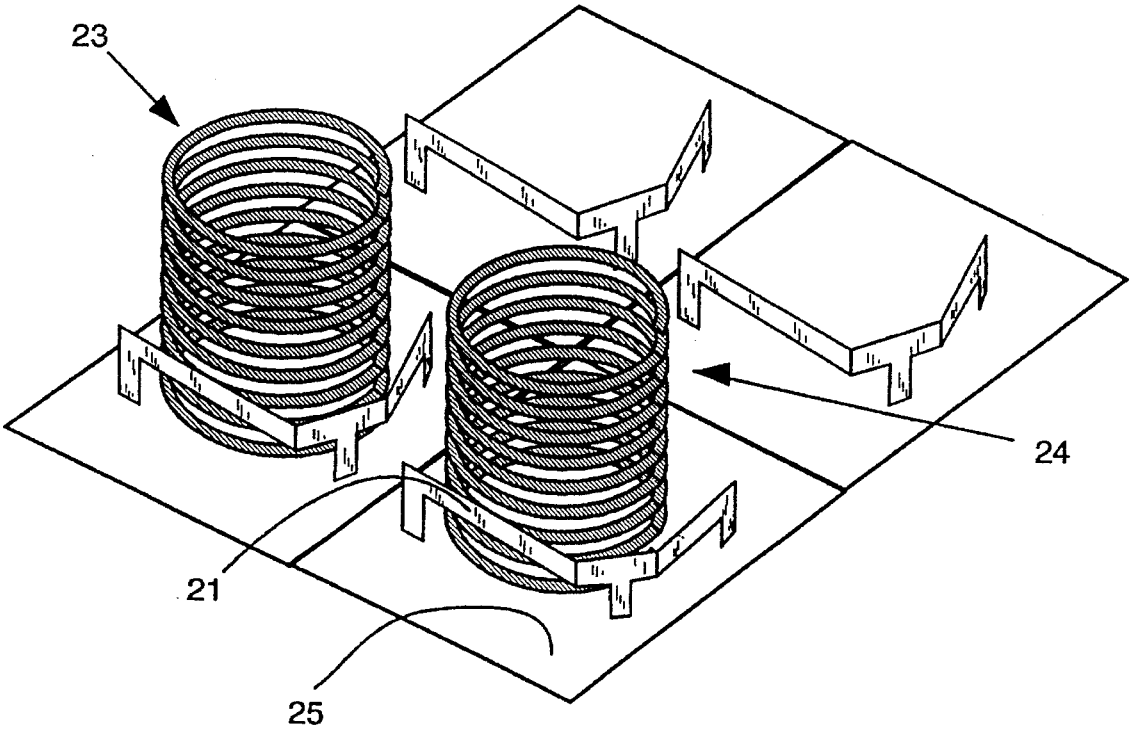
FIG. 3 presents coupling elements installed on a circuit board.

FIG. 3 illustrates a filter with various parts removed comprising four resonators. The filter comprises a circuit board 25, on the surface of which facing the interior of the filter conductive patterns and discrete components (not shown) are provided. Resonator coils are also mounted on the circuit board, only coils 23 and 24 thereof being shown for diagrammatic simplicity. Adjacent to each coil, a coupling element, is mounted. The bent legs of the elements are soldered to conductive pads on the circuit board, or the legs may extend into the holes made in the circuit board if spike-like legs are employed. The filter further comprises a shell with recesses in which each resonator coil is positioned. Each resonator coil is thus encircled by a metallic wall, and so there is no direct electromagnetic coupling between the resonators. The signal is carried to each resonator merely through the inductive coupling element. Thus, a band stop filter, such as a filter for the TX branch of a duplexer, can easily be constructed.

Figure 4:
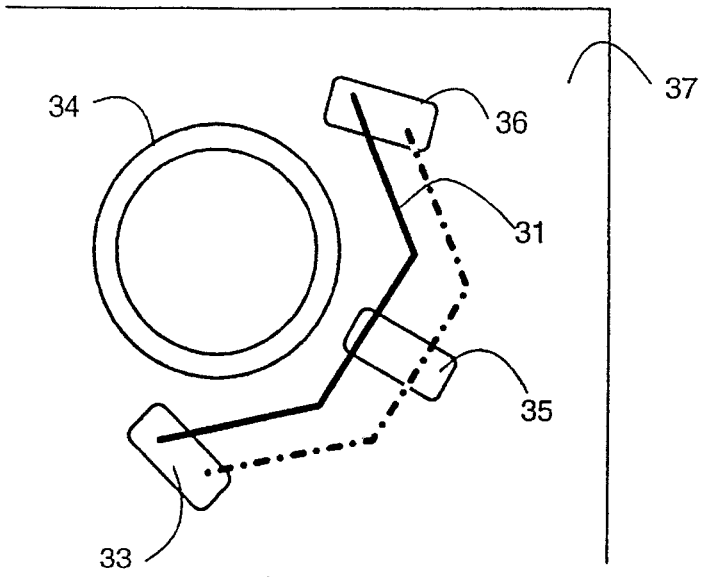
FIG. 4 presents positioning of coupling element relative to the resonator coil, FIGS. 5A, B and C present various tuning alternatives of the coupling element, FIGS. 6A, B and C illustrate an attenuation curve of a step filter with various couplings.

FIG. 4 demonstrates in more detail the positioning of coupling element and a resonator coil relative to each other. The resonator coil 24 is in this Figure presented in top view in the axial direction of the coil. On the circuit board 25 a positioning device, which preferably consists of soldering pads 33, 36 and 35 are arranged to receive the tips of the legs of a coupling element 21. The location of the coupling element 21 on the circuit board is easily be adjusted by using elongate soldering pads so that the coupling legs can be placed in a desired spot within a soldering pad, and thus, within a desired distance from the resonator coil 24 prior to fixing by surface mounting. FIG. 4 shows in an exemplary manner the extreme positions between which the location of the coupling element 21 can be changed by moving the element within the range permitted by the soldering pads. The position of the element is presented with an intact line when it is closest to the resonator coil 24, and the furthermost position with a broken line. The distance between the resonator coil 24 and the adjustment element 21 defines, as is well known in the art, the strength of the electromagnetic coupling.

The positioning of the coupling element may also be asymmetric relative to the resonator coil, Thus departing from FIG. 4, whereby the distance to the resonator coil is different on different sides of the symmetry axis. For installing a coupling element, an installation means designed especially for the purpose may be used, and thereafter the fixing can be performed, e.g. In a reflow soldering machine.

Figure 5A:
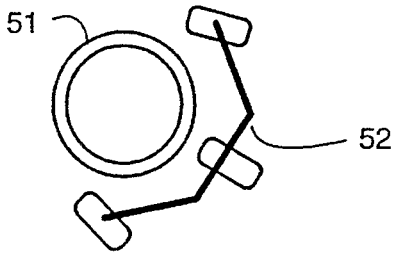
Figure 5B:
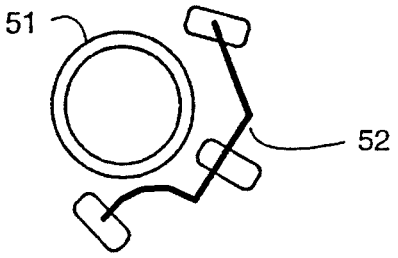
Figure 5C:
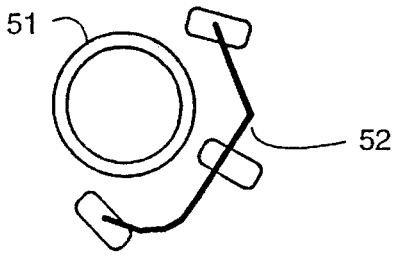

After fixing the coupling element onto the circuit board, the coupling can easily be tuned by bending the strip forming the coupling element either to the resonator coil, or away therefrom. The tuning can be carried out either symmetrically or asymmetrically relative to the symmetry axis of the strip. FIGS. 5A, B and C, in which like reference numerals are used when appropriate, show examples of asymmetric tuning, The figures present the resonator in top view in the axial direction of the helical coil. FIG. 5A presents a resonator coil 51 and a symmetrical coupling element 52 placed at a space therefrom in its fundamental position after fixing. The electromagnetic coupling between the resonator coil 51 and the coupling element 52 shown in FIG. 5B has been increased by bending the strip forming the coupling element 52 on one branch thereof to the resonator coil 51.

Finally, FIG. 6 presents in principle the effect of adjustment on a TX branch filter of a duplex filter. A coupling of the duplex filter, known per se in the art, is presented in FIG. 7. The bandpass filter to the receiver branch is a four-circuit bandpass filter, comprising the helix resonators HX5–HX8. The filter to the transmitter branch is a four-circuit bandstop filter comprising helix resonators HX1–HX4. Each of the resonators of the stop resonator has been disposed in a box of its own (not shown), so that there is no coupling therebetween. The lower end of the resonator of each stop resonator is provided with an inductance Lx in its magnetic field which is composed of a strip design according to the invention. By positioning the strip closer to or further from the resonator exerts an effect on the mutual inductance therebetween, and thus, on the strength of the coupling. By such positioning the minimum of the stop band of the stop filter can be transferred to some extent, and an additional adjustment can be made by bending the strip.

Figure 6A:
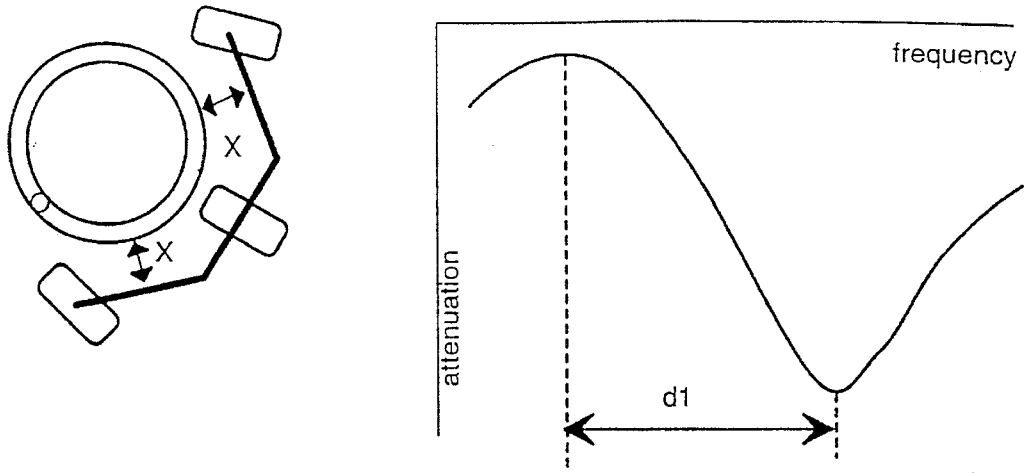
Figure 6B:
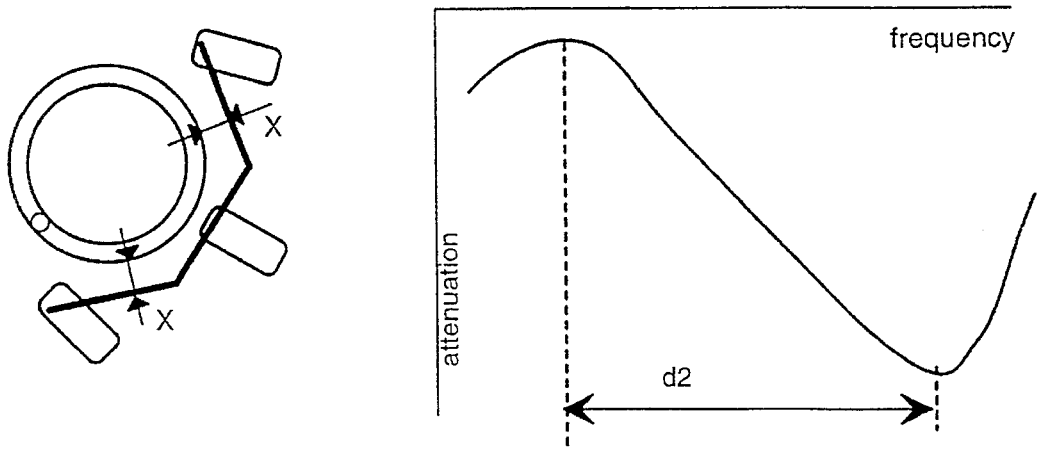
Figure 6C:
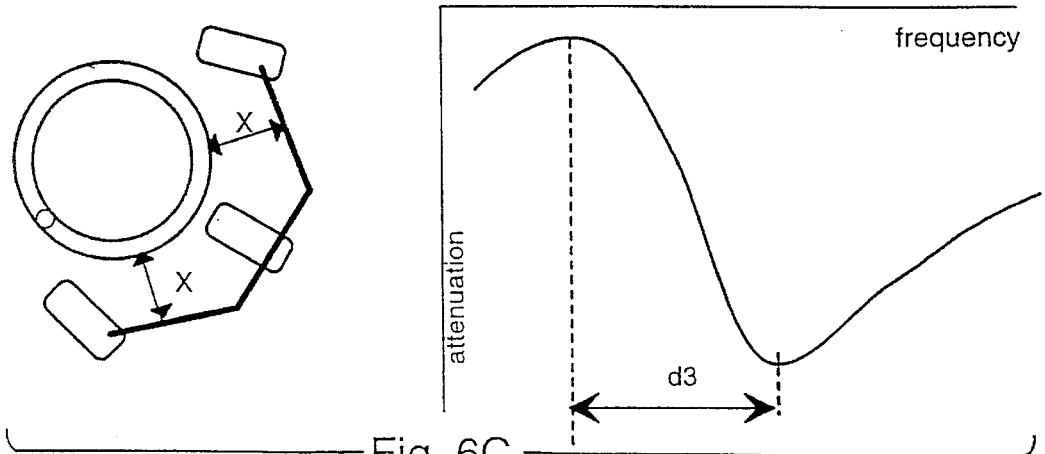
Figure 7:
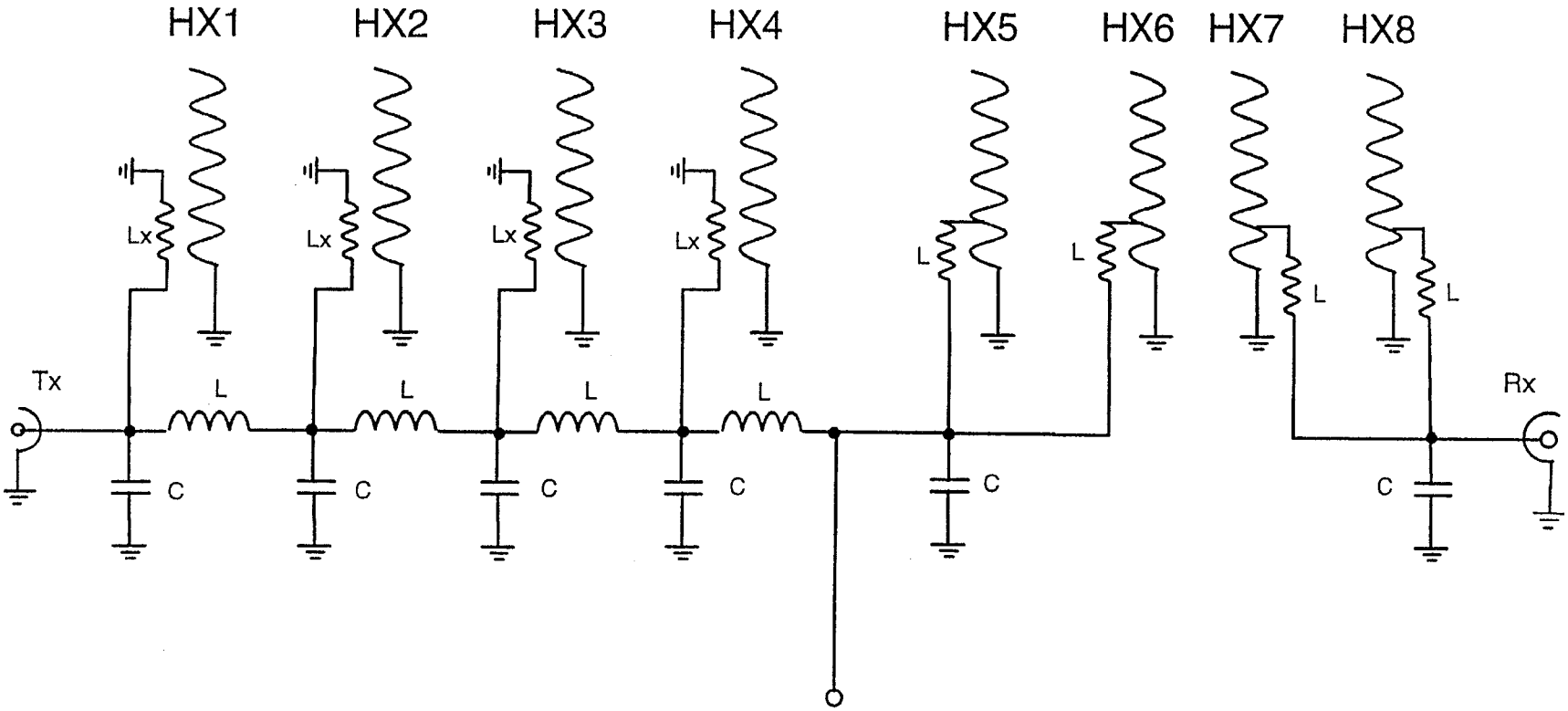
FIG. 7 illustrates circuit coupling of a duplex filter.

The effect of said adjustment is presented in FIGS. 6A, 6B. In FIG. 6A, a coupling strip adjacent to each resonator has been so positioned that the legs thereof are approximately in the middle of the elongate pads shown in FIG. 4. The left side of FIG. 6A illustrates this position. The attenuation curve of the stop filter is now similar to that on the right hand side of FIG. 6A. The distance between the minimum and maximum attenuations is indicated by reference d1. However, if the coupling strip is positioned as shown on the left in FIG. 6B so that its legs are in the extreme position, made possible by the elongate pads, also depicted by the intact line of the strip 31 in FIG. 4, when the strip is very close to the resonator, a powerful coupling is achieved. The attenuation curve is now similar to what is seen on the right in FIG. 6B, the distance d2 between the minimum and maximum attenuations being greater than d1. Furthermore, if the coupling strip is positioned, as shown on the left in FIG. 6C, so that its legs are in the other extreme position, enabled by the elongate pads, which is also depicted by the broken line of the strip 31 in FIG. 4, whereby the strip is at a far distance from the resonator, a weak coupling is produced. Hereby, the attenuation curve is similar to that presented on the right in FIG. 6C, and the distance d3 between the minimum and the maximum attenuations is less than d1. An individual fine adjustment of the coupling is made by bending the coupling strip or part thereof. In this manner, using one and same filter design, a filter can be provided the duplex interval of which is easy to change to correspond to the specification of a desired radio phone system. With the one and same filter, a plurality of radio phone systems can thus be covered.

A coupling element of the invention is easy to manufacture, and in practice it has been found to substitute all wire link models of different thicknesses and shapes. Thanks to its symmetrical shape, its positioning is always successful, irrespective of the size and position of the resonator coil used. As regards surface mounting, the coupling element is particularly advantageous. Symmetry and surface-mountability create an opportunity for stepless adjustment concerning the location of a coupling element on a circuit board in the assembly phase by making the soldering pads elongated. Tuning a coupling element is accomplished simply by bending the flexible strip which makes the coupling element either towards the resonator coil or away therefrom when an equivalent measure with a wire link would require detaching of the link from the soldering and adjustment of the link in up-and-down direction into a correct plane, which for practical reasons is nearly impossible; therefore, the adjustment should in most cases be made correct prior to soldering the link.

The alternatives embodiments of the invention are not confined to the examples described above, and the invention can be applied within the limits permitted by the annexed claims.

We claim:

1. A resonator device suitable for use in a radio frequency filter comprising:

a helical resonator coil mounted on a circuit board and an elongate inductive coupling element mounted in a positioning device at an adjustable distance from the helical resonator coil on the circuit board and in electromagnetically-coupled relation to the helical resonator coil, the coupling element having a short-circuited end and an end for providing a signal path to the resonator device, wherein the coupling element comprises a fork-like conductive strip comprising two branches between which the helical resonator coil is located, the coupling element being selectively fixedly connected to the positioning device at one of a plurality of predetermined positions.

2. A resonator device as in claim 1, wherein the two branches are connected by an intermediate part.

3. A resonator device as in claim 2, wherein the coupling element includes support legs one of which is short-circuited and another of which provides a signal path to the resonator device.

4. A resonator devise as in claims 1 or 3, wherein each branch can be bent separately for increasing or decreasing the coupling between the resonator coil and the branch.

5. A resonator device as in claim 1, wherein the coupling element is formed from one integrated piece of material.

6. A resonator device as in claim 3, wherein each support leg includes a tip and the tips of the support legs have been bent to facilitate surface mounting.

7. A resonator device as in claim 3, wherein at least one support leg is made of insulation material.

8. A resonator device as in claim 5, wherein said element is made of copper web.

9. A resonator device as in claim 6, wherein the tips of the support legs have been soldered on elongate conductor pads on the surface of the circuit board whereby the location of the coupling element can be selected within the limits permitted by the pads before soldering.

10. A resonator device as in claim 1, wherein the positioning device includes soldering pads arranged on the circuit board.

11. A resonator device which comprises:

a circuit board having a helical resonator coil and a coupling element positioning device in proximity to the helical resonator; and an inductive coupling element adjustably mounted in the positioning device and at an adjustable distance and in electromagnetic coupled relationship to the helical resonator coil, wherein the coupling element is selectively fixedly connected to the positioning device at one of a plurality of predetermined positions.

12. A resonator device as in claim 11, wherein the inductive coupling element includes at least one leg portion.

13. A resonator device as in claim 12, wherein the positioning device includes at least one soldering pad in which the at least one leg portion of the inductive coupling element is adjustably mounted thereinto.

* * * * *